US005113543A

United States Patent [19]

Sevenet

[11] Patent Number: 5,113,543

[45] Date of Patent: May 19, 1992

[54] SYSTEM FOR ASSEMBLING A CROSSING STRUCTURE FOR THE BRIDGING OF GAPS

[75] Inventor: Jacques Sevenet, Le Breuil, France

[73] Assignee: Framatome, Courbevoie, France

[21] Appl. No.: 631,167

[22] Filed: Dec. 20, 1990

[30] Foreign Application Priority Data

Dec. 26, 1989 [FR] France ..... 8917191

[51] Int. Cl.[5] ..... E01D 1/00

[52] U.S. Cl. ..... 14/24; 14/14

[58] Field of Search ..... 14/13, 14, 24–26

[56] References Cited

U.S. PATENT DOCUMENTS 4,965,903 10/1990 Bisch ..... 14/14 X

*Primary Examiner*—Thuy M. Bui

*Attorney, Agent, or Firm*—Pollock, Vande Sande & Priddy

[57] ABSTRACT

A system for assembling a crossing structure for the bridging of gaps, comprising at least two sections (1) which are placed end to end to form at least one runway and of which at least the mutually opposite ends (1*a*, 1*b*) are equipped with interlocking members (10) of complementary shape comprising a succession of projecting parts (11) and of recesses (12).

10 Claims, 4 Drawing Sheets

SYSTEM FOR ASSEMBLING A CROSSING STRUCTURE FOR THE BRIDGING OF GAPS

FIELD OF THE INVENTION

The present invention relates to a system for assembling a crossing structure intended especially for the bridging of gaps by so-called heavy vehicles, for example armored vehicles.

BACKGROUND OF THE INVENTION

The bridging of gaps or other passages between two raised edges by so-called heavy vehicles requires crossing structures which are not only adapted for rapid laying, but are also a light, making it easier for them to be transported and put to use.

These requirements of lightness and easy handling conflict with the properties of sturdiness, mechanical strength and bending resistance required in view of the weight of the vehicles which may use these crossing structures.

These crossing structures are generally either, of the scissor type or simple crossing structures in the form of a plurality of sections which can butt against one another.

The scissor-type crossing structures comprise two or three inseparable elements which are extended by rotation in a vertical plane about the common axis of the two elements.

After deployment, these crossing structures can be laid either by means of a jib or with the aid of a manipulator.

The main disadvantage of scissor-type crossing structures is that, during deployment or laying, the entire crossing structure is cantilevered in relation to the carrier vehicle, thus making it necessary to limit the weight of the crossing structures and therefore causing a limitation in their length and consequently that of the gaps which can be bridged.

Moreover, during deployment or laying, the crossing structure rises to such a height that it can easily be detected by enemy observation facilities. On the other hand, the jointing and deployment system makes the assembly as a whole considerably heavier, this making it necessary to limit its reach because the forces on the cantilevered deployment system become too great.

In the case of a simple crossing structure, the sections are transported superposed on one another and then deployed in translational motion by a manipulator which also serves for laying the structure.

With this type of crossing structure, however, the sections have to be centered, assembled and locked with one another before being laid.

To date, the sections have been assembled together by means of centering and connecting members formed, for example, by bolts or keys or mechanical assemblies comprising a device with a rack and with a pawl actuated by a pusher.

The centering and connecting members employed are often complicated to use because of the dimensions of the sections, thus making it necessary for several crew members to be present outside the vehicle for controlling and guiding the maneuvers.

This need considerably restricts the use of such crossing structures, because it prevents them from being used in a contaminated atmosphere, such as may be encountered during nuclear, bacteriological or chemical warfare.

SUMMARY OF THE INVENTION

The object of the present invention is, therefore, to provide a system for assembling a crossing structure, which avoids the abovementioned disadvantages and which is especially simple and easy to use.

The subject of the present invention is, therefore, a system for assembling a crossing structure for the bridging of gaps, comprising at least two sections which are placed end to end to form at least one runway and of which at least the mutually opposite ends are equipped with connection means, which interlocking members of complementary shape formed at the corresponding end of each section by a succession of projecting parts and of recesses offset relative to those of the end of the other section located opposite.

According to other characteristics of the invention:

the two ends of each section are equipped with projecting parts and with recesses, the projecting parts and recesses of each opposite end of the said section being offset relative to one another;

the projecting parts have a trapezoidal profile converging towards the end of the section;

the projecting parts have a base of polygonal cross-section;

the recesses are extended by a receptacle inside the section;

each receptacle has a profile complementary to the profile of the associated projecting part;

the profile of each receptacle is trapezoidal converging towards the center of the section;

the bottom of each receptacle has an orifice perpendicular to the axis of the receptacle and opening out on either side of the section;

each section has, on its face forming a runway, a protective clothing covering for the interlocking members;

the coverings of two sections assembled with one another overlap in the region of the joining plane of the said sections.

BRIEF DESCRIPTION OF THE DRAWINGS

The invention will be better understood from the following description given purely by way of example and with reference to the accompanying drawings, in which.

DETAILED DESCRIPTION

Figure 2:
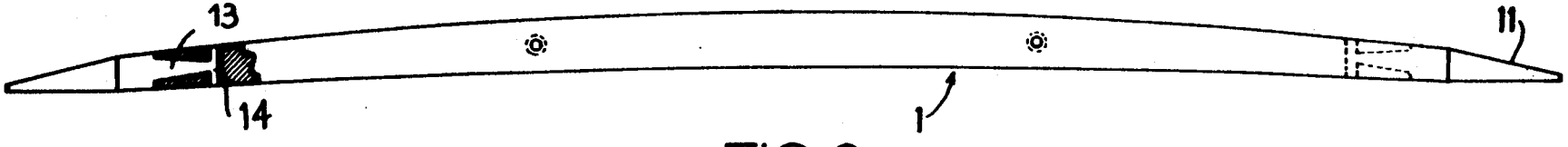
FIG. 2 is a side view of a section of the crossing structure of FIG. 1.
Figure 1:
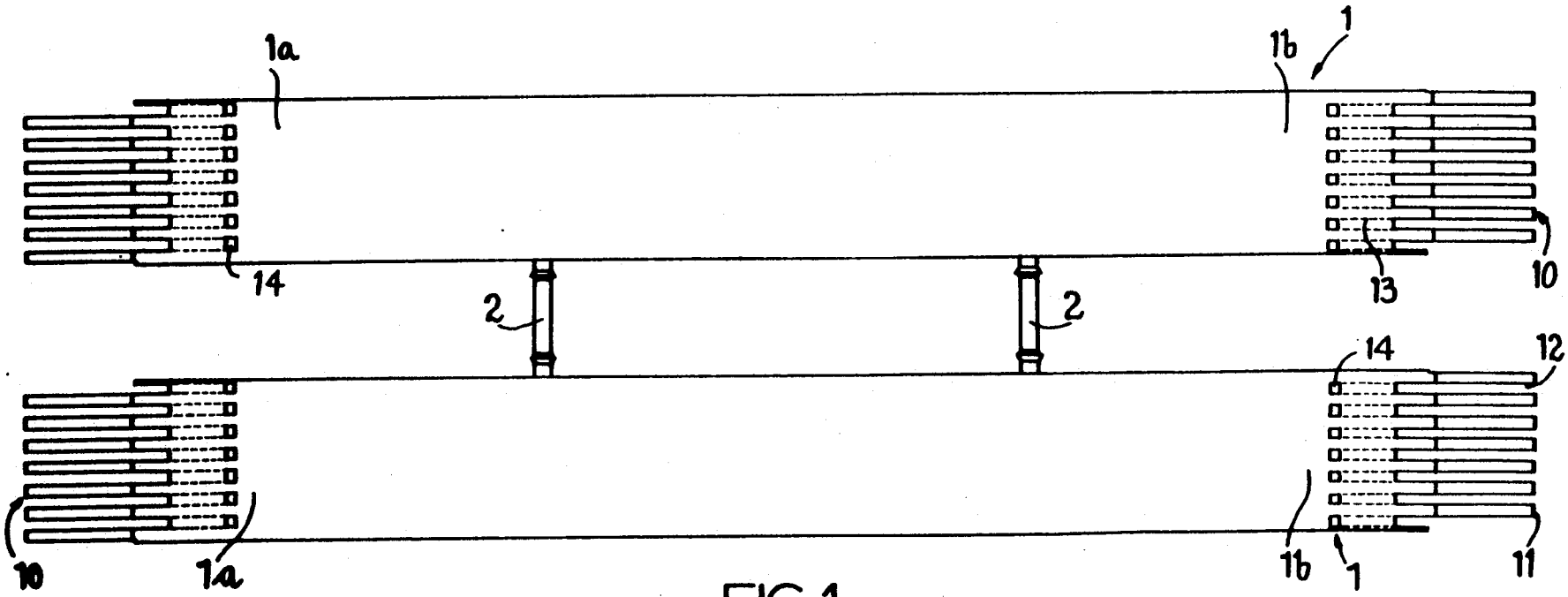
FIG. 1 is a top plan view of two sections of a crossing structure equipped with an assembly system according to the invention.
Figure 3:
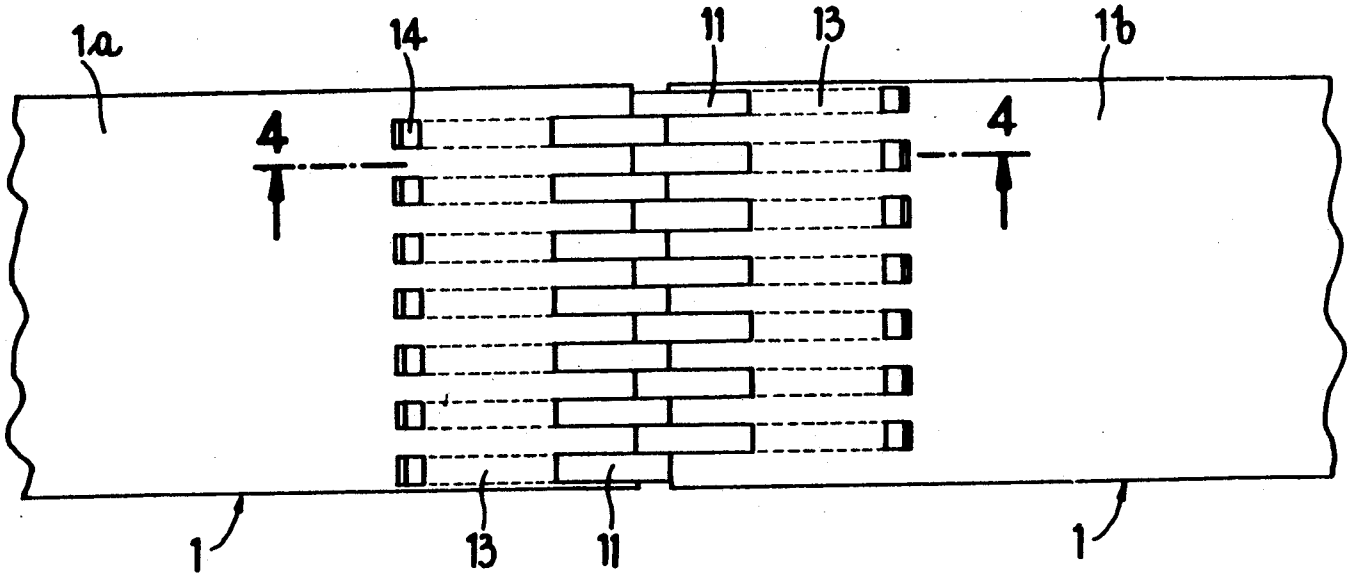
FIG. 3 is a top plan view on a larger scale showing the assembling of two sections placed end to end.

The crossing structure illustrated in FIGS. 1 to 3 is composed of a plurality of pairs of sections 1, the sections of each pair being connected to one another by means of crosspieces 2.

For the bridging of gaps, a plurality of pairs of sections 1 are placed end to end to form at least one runway allowing vehicles to pass.

For this purpose, each end 1*a* and 1*b* of each of the sections 1 has interlocking members of complementary shape designated by the reference 10.

These interlocking members are formed by a succession of projecting parts 11 and of recesses 12.

As can be seen in FIG. 2, the projecting parts 11 have a trapezoidal profile converging towards the end of the section 1 and a base of polygonal cross-section.

Each recess 12 is extended by a receptacle 13 located inside the section 1 and having a profile complementary to the profile of the projecting parts 11, i.e., trapezoidal and converging towards the center of the said section.

Moreover, the bottom of each receptacle 13 is pierced by an orifice 14 perpendicular to the axis of said receptacle and opening out on both sides of the section.

These orifices 14 make it possible to clean the receptacles 13.

The projecting parts 11 and the recesses 12 of each end 1*a* and 1*b* of the section 1 are offset relative to one another.

Thus, a projecting part 11 of the end 1*a* of a section 1 corresponds to a recess 12 of the end 1*b* of this same section.

The sections may have projecting parts 11 and recesses 12 at only one of their ends, each projecting part 11 and each recess 12 being offset relative to those of the end of the other section located opposite at the time of assembly.

Figure 4:
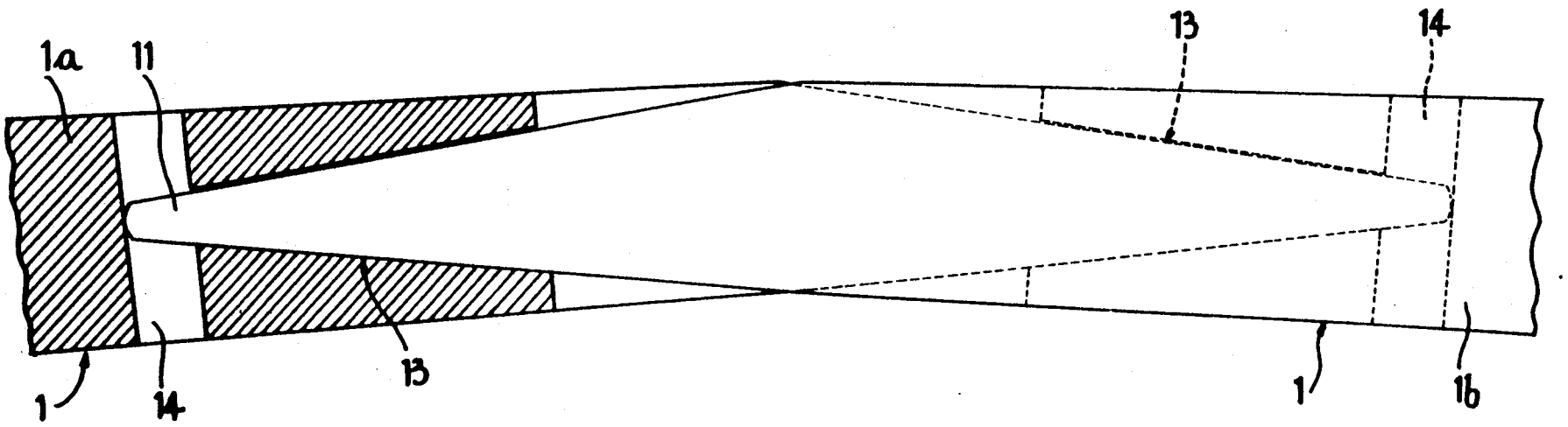
FIG. 4 is a sectional view along line 4—4 of FIG. 3.

When each pair of sections 1 is being assembled with the pair of sections located opposite, the projecting parts 11 of each section penetrate into the recesses 12 and take their place in the receptacles 13 of the opposite section, as shown in FIGS. 3 and 4.

As a result of the particular profiled shape of the projecting parts 11 and of the receptacles 13, the sections are therefore automatically aligned with one another at the time when the crossing structure is formed, thus obviating differences in level between the sections.

The interlocking members 10 make it possible to use as many pairs of sections 1 as are required by the dimensions of the gap to be bridged.

This arrangement eliminates the maneuvers of positioning and centering one section relative to the other, which in most instances are difficult because of the weight and dimensions of the sections.

Figure 5:
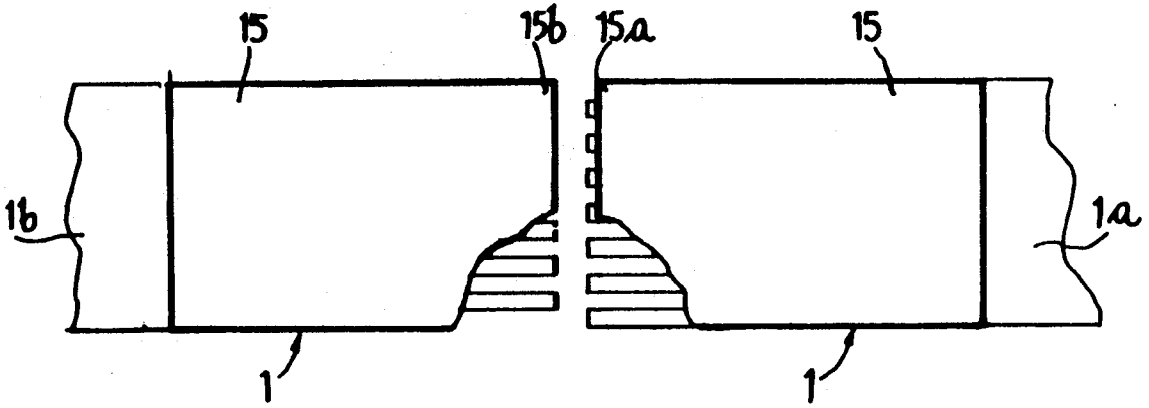
FIG. 5 is a top plan view of the mutually confronting ends of two opposite sections of the crossing structure, each equipped with a protective covering.
Figure 6:
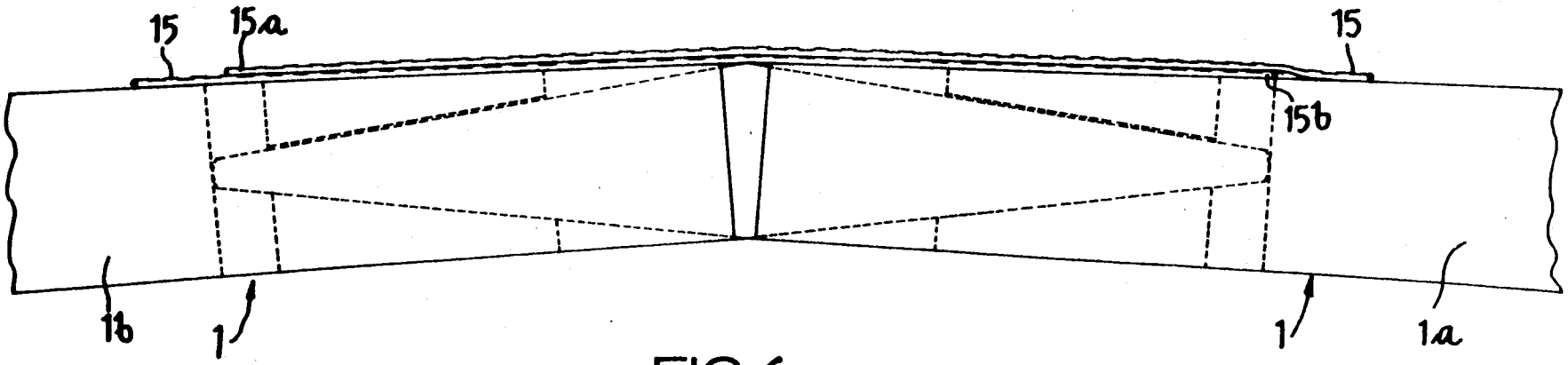
FIG. 6 is a side view of two assembled sections showing the overlap of the protective covering.

The upper face of each section is provided, in the region of the interlocking members 10, with a protective clothing 15 (FIGS. 5 and 6), comprising bumps to preventing vehicles using the crossing structure from skidding.

The end 15*a* of the covering 15 partially covers the projecting parts 11 and the recesses 12 of end 1*a* of the section 1, while the end 15*b* of the covering completely covers the projecting parts 11 and the recesses 12 of end 1*b* of the section.

The end 15*b* of covering 15 is profiled. Thus, when two opposite sections are assembled together, end 15*b* of the covering of one of the sections 1 lifts the end 15*a* of the covering of the other section, with the result that the said ends overlap and cover the joining plane of the two sections.

Because of the simplicity of the system according to the invention, the crossing structure can be assembled automatically, quickly and reliably and needs no connection to auxiliary devices for the supply of, for example, electrical or hydraulic energy.

I claim:

1. System for assembling a crossing structure for the bridging of gaps, comprising at least two sections to be joined end to end to form at least one runway and having mutually opposite ends provided with interlocking members of complementary shape formed at a corresponding end of each section by a succession of projecting parts and of recesses offset relative to the respective projecting parts and recesses of the end of the other section.

2. System according to claim 1, wherein the two ends of each section comprise projecting parts and recesses, said projecting parts and said recesses of each opposite end of said section being offset relative to one another.

3. System according to claim 1, wherein said projecting parts have a trapezoidal profile converging towards the end of said section.

4. System according to claim 1, wherein said projecting parts have a base of polygonal cross-section.

5. System according to claim 1, wherein said recesses are extended by a receptacle inside said section.

6. System according to claim 5, wherein each said receptacle has a profile complementary to a profile of an associated projecting part.

7. System according to claim 6, wherein the profile of each receptacle is trapezoidal converging towards a center of said section.

8. System according to claim 5, wherein a bottom of each receptacle comprises an orifice perpendicular to an axis of said receptacle and opening out on both sides of said section.

9. System according to claim 1, wherein each section has a face forming a runway, said face being provided with a protective covering for said interlocking members.

10. System according to claim 9, wherein the coverings of two sections assembled with one another overlap in a region of a plane joining said sections.

* * * * *